US008127853B2

(12) United States Patent
Pallini et al.

(10) Patent No.: US 8,127,853 B2
(45) Date of Patent: Mar. 6, 2012

(54) INTERNAL TIEBACK FOR SUBSEA WELL

(75) Inventors: Joseph W. Pallini, Tomball, TX (US); Rockford D. Lyle, Pinehurst, TX (US); Gregory M. Dunn, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 13/036,737

(22) Filed: Feb. 28, 2011

(65) Prior Publication Data

US 2011/0155382 A1 Jun. 30, 2011

Related U.S. Application Data

(63) Continuation of application No. 12/118,443, filed on May 9, 2008, now Pat. No. 7,896,081.

(51) Int. Cl.
*E21B 23/00* (2006.01)

(52) U.S. Cl. ..... 166/345; 166/338; 166/339; 166/341; 166/367; 166/77.1; 285/18

(58) Field of Classification Search ..... 166/345, 166/338, 339, 341, 344, 351, 367, 368, 381, 166/77.1, 85.1; 285/18, 34, 123.1
See application file for complete search history.

(56) References Cited

U.S. PATENT DOCUMENTS

| | | | | | |
|---|---|---|---|---|---|
| 3,521,909 | A | * | 7/1970 | Brown Cicero C | 285/3 |
| 4,456,070 | A | * | 6/1984 | Watkins | 166/345 |
| 4,641,708 | A | * | 2/1987 | Wightman | 166/208 |
| 4,655,479 | A | * | 4/1987 | Farr, Jr. | 285/18 |
| 4,665,979 | A | * | 5/1987 | Boehm, Jr. | 166/208 |
| 4,872,708 | A | * | 10/1989 | Abreo, Jr. | 285/39 |
| 4,903,992 | A | * | 2/1990 | Jennings et al. | 285/24 |
| 4,976,458 | A | * | 12/1990 | Hosie et al. | 285/24 |
| 5,004,273 | A | * | 4/1991 | Baugh | 285/27 |
| 5,080,173 | A | * | 1/1992 | Brammer | 166/348 |
| 5,211,226 | A | * | 5/1993 | Hendrickson et al. | 166/118 |
| 5,240,076 | A | * | 8/1993 | Cromar et al. | 166/382 |
| 5,259,459 | A | * | 11/1993 | Valka | 166/345 |
| 5,299,642 | A | * | 4/1994 | Nelson et al. | 166/368 |
| 5,368,335 | A | * | 11/1994 | Dinnes | 285/18 |
| 5,372,201 | A | * | 12/1994 | Milberger | 166/382 |
| 5,566,761 | A | * | 10/1996 | Pallini et al. | 166/345 |

(Continued)

FOREIGN PATENT DOCUMENTS

GB 2255605 A 11/1992

(Continued)

*Primary Examiner* — Thomas Beach
*Assistant Examiner* — Matthew Buck
(74) *Attorney, Agent, or Firm* — Bracewell & Giuliani LLP

(57) ABSTRACT

A tieback connector connects a tieback conduit from an offshore platform to a subsea wellhead assembly. The tieback connector has a mandrel that is connected to a string of tieback conduit and a sleeve and load ring that are carried by the mandrel. The load ring is radially expansible and has a conical portion with internal threads. The load ring has an external grooved profile that engages an internal grooved profile in the subsea assembly. The mandrel is rotatable relative to the sleeve while in its lower position, causing the load ring to further expand outward into engagement with the internal profile. A locking member is carried below the load ring on an exterior cam surface of the mandrel. The cam surface moves the locking member outward when the mandrel moves downward into engagement with an internal profile in the subsea assembly.

20 Claims, 9 Drawing Sheets

U.S. PATENT DOCUMENTS

| | | | | |
|---|---|---|---|---|
| 5,638,903 | A * | 6/1997 | Kent | 166/348 |
| 5,775,427 | A * | 7/1998 | Skeels et al. | 166/344 |
| 6,234,252 | B1 | 5/2001 | Pallini, Jr. et al. | |
| 6,260,624 | B1 * | 7/2001 | Pallini et al. | 166/345 |
| 6,293,343 | B1 | 9/2001 | Pallini, Jr. et al. | |
| 6,302,211 | B1 * | 10/2001 | Nelson et al. | 166/348 |
| 6,520,263 | B2 * | 2/2003 | June | 166/368 |
| 6,666,272 | B2 * | 12/2003 | Singeetham et al. | 166/345 |
| 7,156,169 | B2 * | 1/2007 | Bartlett | 166/66.7 |
| 7,234,528 | B2 * | 6/2007 | Pallini et al. | 166/343 |
| 7,380,607 | B2 * | 6/2008 | Thomas | 166/348 |
| 7,387,166 | B2 * | 6/2008 | Bartlett | 166/335 |
| 7,537,057 | B2 * | 5/2009 | Singeetham et al. | 166/343 |
| 7,735,562 | B2 * | 6/2010 | Bennett et al. | 166/345 |
| 7,896,081 | B2 * | 3/2011 | Pallini et al. | 166/345 |
| 2001/0045286 | A1 * | 11/2001 | Pallini et al. | 166/345 |

FOREIGN PATENT DOCUMENTS

| | | | |
|---|---|---|---|
| GB | 2272033 | A | 5/1994 |
| GB | 2302924 | A | 2/1997 |
| GB | 2362906 | A | 12/2001 |
| GB | 2424663 | A | 10/2006 |

* cited by examiner

INTERNAL TIEBACK FOR SUBSEA WELL

CROSS-REFERENCE TO RELATED APPLICATION

This application is a continuation of Ser. No. 12/118,443, filed May 9, 2008, U.S. Pat. No. 7,896,081, to issue Mar. 1, 2011.

FIELD OF THE INVENTION

This invention relates in general to subsea oil and gas well production, and in particular to a tieback connector extending from the subsea well to a platform at the surface.

BACKGROUND OF THE INVENTION

Subsea wells typically have a subsea wellhead assembly at the seafloor. In some installations, a subsea production tree will be mounted on the wellhead assembly. The tree has valves connected to flowlines for controlling flow from the well. In another type of installation, a string of tieback conduit extends from the subsea wellhead assembly to a platform at the surface. A surface tree is mounted on the upper end of the tieback conduit. Some riser systems have inner and outer tieback conduits, each of which is run separately and connected by a tieback connector. The inner and outer tieback conduits make up the tieback riser in that type of system.

The inner tieback conduit is installed by connecting a tieback connector to the lower end of the conduit and lowering it into the bore of the subsea wellhead housing assembly. The tieback connector has a locking member that locks to the subsea wellhead housing or to the tapered stress joint at the bottom of the outer tieback conduit. The inner tieback connector also has a seal that seals to an internal component of the subsea wellhead housing assembly. Typical outer tieback connectors are locked to the exterior of the subsea wellhead housing assembly. Other outer tieback connectors are locked to the interior. An internal tieback connector typically has a mandrel with a sleeve on the exterior. The mandrel is connected to the inner tieback conduit and is capable of moving between an upper running-in position and a lower landed position in the subsea wellhead housing. An actuator holds the mandrel in the upper position until the actuator lands on structure in the wellhead housing. Then, downward movement of the inner tieback conduit causes the locking member to engage an internal profile in the subsea wellhead housing assembly.

SUMMARY OF THE INVENTION

The tieback apparatus of this invention has a sleeve and a mandrel installed within the sleeve. The mandrel is movable between an upper position and a lower position relative to the sleeve. In one mode, the movement is without rotation of the inner tieback conduit, and in another mode, the movement is caused by rotation. The mandrel has an exterior tapered portion with a set of external threads. The threads increase in diameter from a lower end to an upper end. A radially expansible load ring is carried by the sleeve. The load ring has a set of internal threads that ratchet over the external threads as the mandrel moves from the upper position to the lower position. The load ring has an external profile that mates with an internal profile of the subsea well assembly when the mandrel is in the lower position. In the embodiment shown, the internal profile is located within the lower portion or stress joint of an external riser. The mandrel is rotatable relative to the sleeve and the load ring while in the lower position. This rotation causes the internal threads to advance upward relative to the external threads to further expand the load ring into engagement with the internal profile of the subsea well assembly. In an alternate mode of operation, all of the expansion of the load ring is caused by rotation.

In one embodiment, the internal profile of the subsea well assembly is located within a stress joint of a riser that is connected to the subsea wellhead housing. The load ring thus engages the internal profile in the riser, connecting the tieback conduit to the mandrel.

In addition to locking to the riser stress joint, optionally, the tieback connector also locks to an internal profile located within the subsea wellhead housing. A locking member is carried by the sleeve below the load ring. The mandrel has an exterior cam surface that slides downward relative to the locking member to expand it outward at the same time as the load ring is being expanded outward. Preferably, the mandrel has threads above the cam surface that mate with threads of the locking member so that when the mandrel is rotated to further expand the load ring, it also engages the locking member threads with the mandrel threads. In the preferred embodiment, the locking member comprises a plurality of dogs spaced around the sleeve.

DETAILED DESCRIPTION OF THE INVENTION

Figure 1:
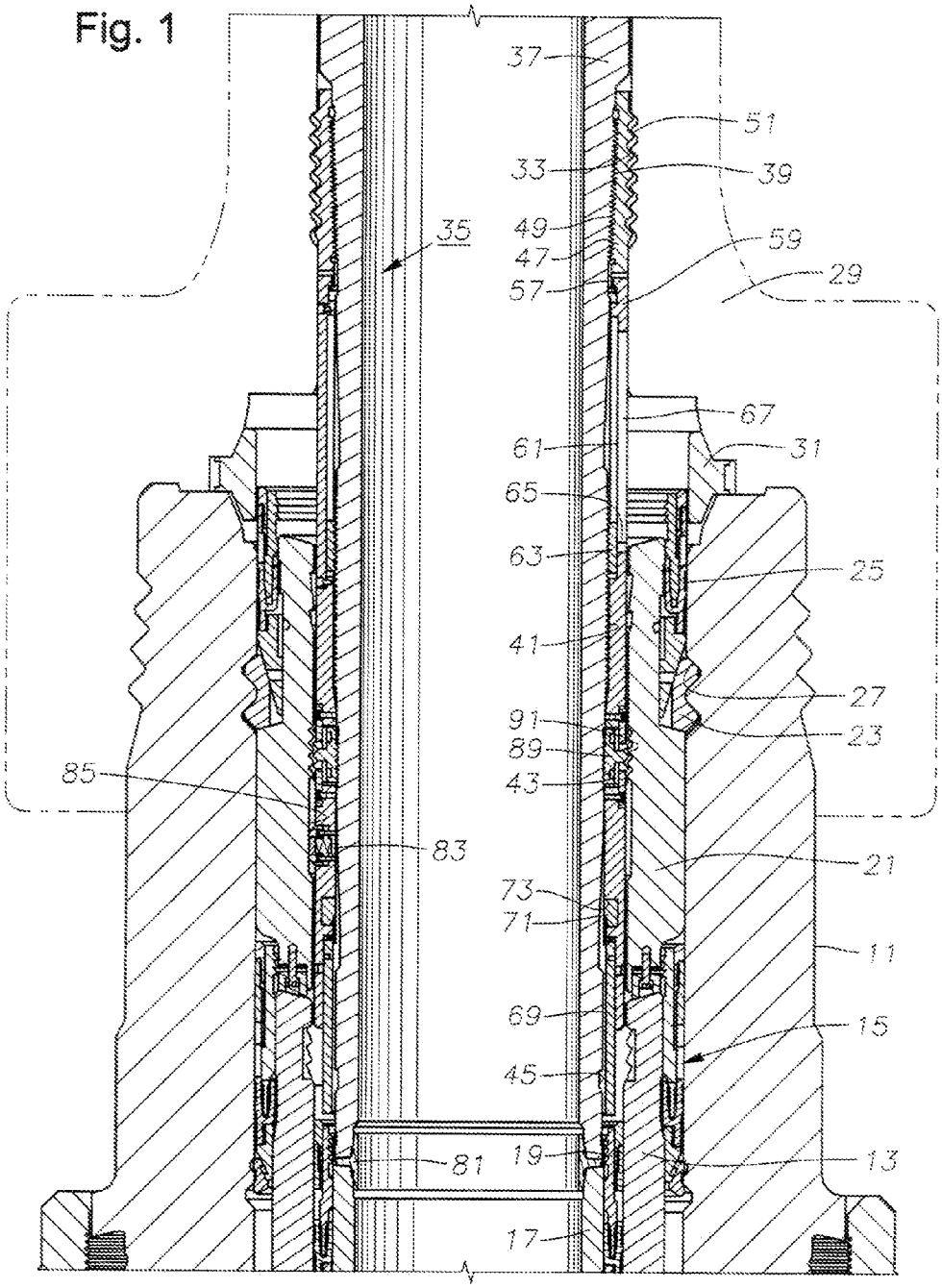
FIG. 1 is a sectional view illustrating an inner tieback connector in the landed and connected positions.

Referring to FIG. 1, wellhead housing 11 is located at the seafloor at the upper end of a well. Wellhead housing 11 is a tubular member having a bore containing at least one casing hanger 13. Casing hanger 13 is secured to a string of casing that extends to a selected depth in the well. A packoff assembly 15 seals between casing hanger 13 and the bore of wellhead housing 11.

In this example, a second casing hanger 17 is landed within casing hanger 13. Casing hanger 17 is attached to a string of casing that extends to a greater depth in the well than the casing attached to casing hanger 13. A second packoff assembly 19 secures the annulus between casing hangers 13 and 17.

In this example, a lockdown member 21 lands on top of casing hanger 13 to prevent upward movement of casing hanger 13. Lockdown member 21 is a tubular member that is secured by a split lock-ring 23 or a segmented dog ring to an internal groove or profile 27 formed in the bore of the wellhead housing 11. Lock ring 23 is energized or expanded to the locked position by a packoff assembly 25 that is wedged between lockdown member 21 and the bore of wellhead housing 11. Other arrangements of the structure within wellhead housing 11 are feasible, including mounting the second casing hanger on top of the first casing hanger, rather than within. Also, lockdown member 21 may be eliminated in some installations. The arrangement of this example is employed for a high pressure and high temperature well.

In this example, an external riser 29, which is an outer tieback conduit, connects to an exterior profile on wellhead housing 11 and extends upward to a surface platform. A gasket 31 seals riser 29 to the interior of wellhead housing 11. Riser 29 has an internal profile 33 that in this instance comprises a plurality of rounded, parallel grooves, but other configurations are feasible.

An inner tieback connector 35 is employed to connect a string of inner tieback conduit (not shown) to the subsea well assembly, which includes wellhead housing 11 and its internal components, as well as the lower end or stress joint of riser 29. Inner tieback connector 35 has a mandrel 37, which is an inner tubular member, that is secured to the string of conduit. Mandrel 37 has an upper external set of threads 39 that are located on a tapered or conical surface. The lower end of external threads 39 has a smaller diameter than the upper end, as shown in FIG. 1. Mandrel 37 also has a set of intermediate external threads 41. Threads 41 are located on a cylindrical portion of the exterior of mandrel 37. Mandrel 37 also has a lower set of external threads 43 that are located on a cylindrical portion of mandrel 35 above a tapered or conical surface. Upper threads 39, intermediate threads 41 and lower threads 43 have preferably the same pitch. In addition, mandrel 37 has an exterior groove 45 located near its lower end.

An expandable load ring 47 is carried by mandrel 37. Load ring 47 has a set of tapered internal threads 49 that have the same taper as external threads 39. Threads 49 will mesh with external threads 39 while mandrel 37 is in the lower position shown in FIG. 1. Load ring 47 also has an external grooved profile 51 that is configured to mate with riser internal profile 33.

Figure 9:
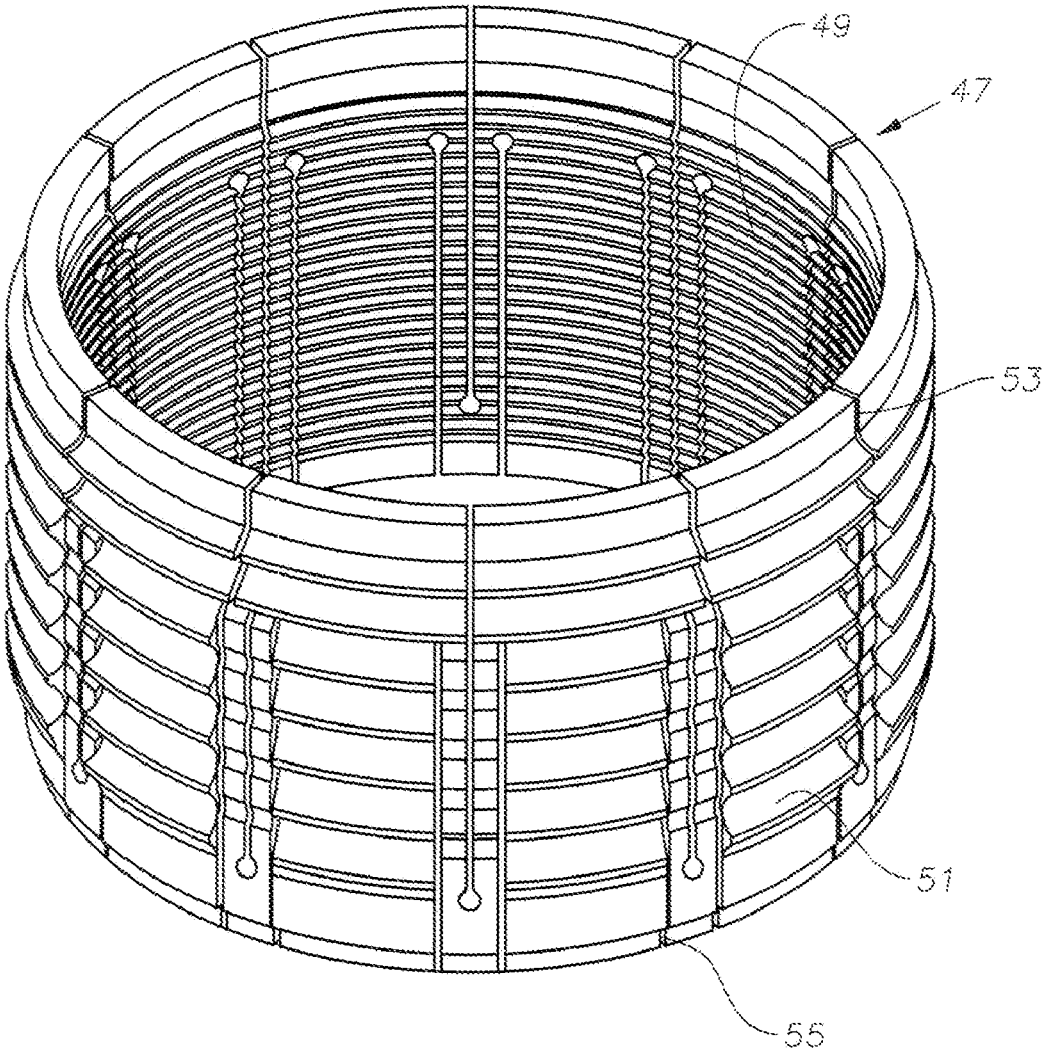
FIG. 9 is a perspective view of the load ring of the tieback connector of FIG. 1.

Referring to FIG. 9, load ring 47 is preferably a collet member having serpentine slots, but it could alternately be a split C-ring. These slots include upper slots 53 that extend downward from the upper edge of load ring 47 to a point near the lower edge. Lower slots 55 extend from the lower edge upward to a point below the upper end of load ring 47. Slots 53, 55 are parallel with a central axis of load ring 47.

Referring back to FIG. 1, load ring 47 is secured in this embodiment by a clamp 57 or bolted retainer pieces to a sleeve 59. Clamp 57 prevents both axial and rotational movement of load ring 47 relative to sleeve 59. Other devices may be used to connect load ring 47 with sleeve 59, as discussed below in connected with the second embodiment of FIG. 10.

Figure 2:
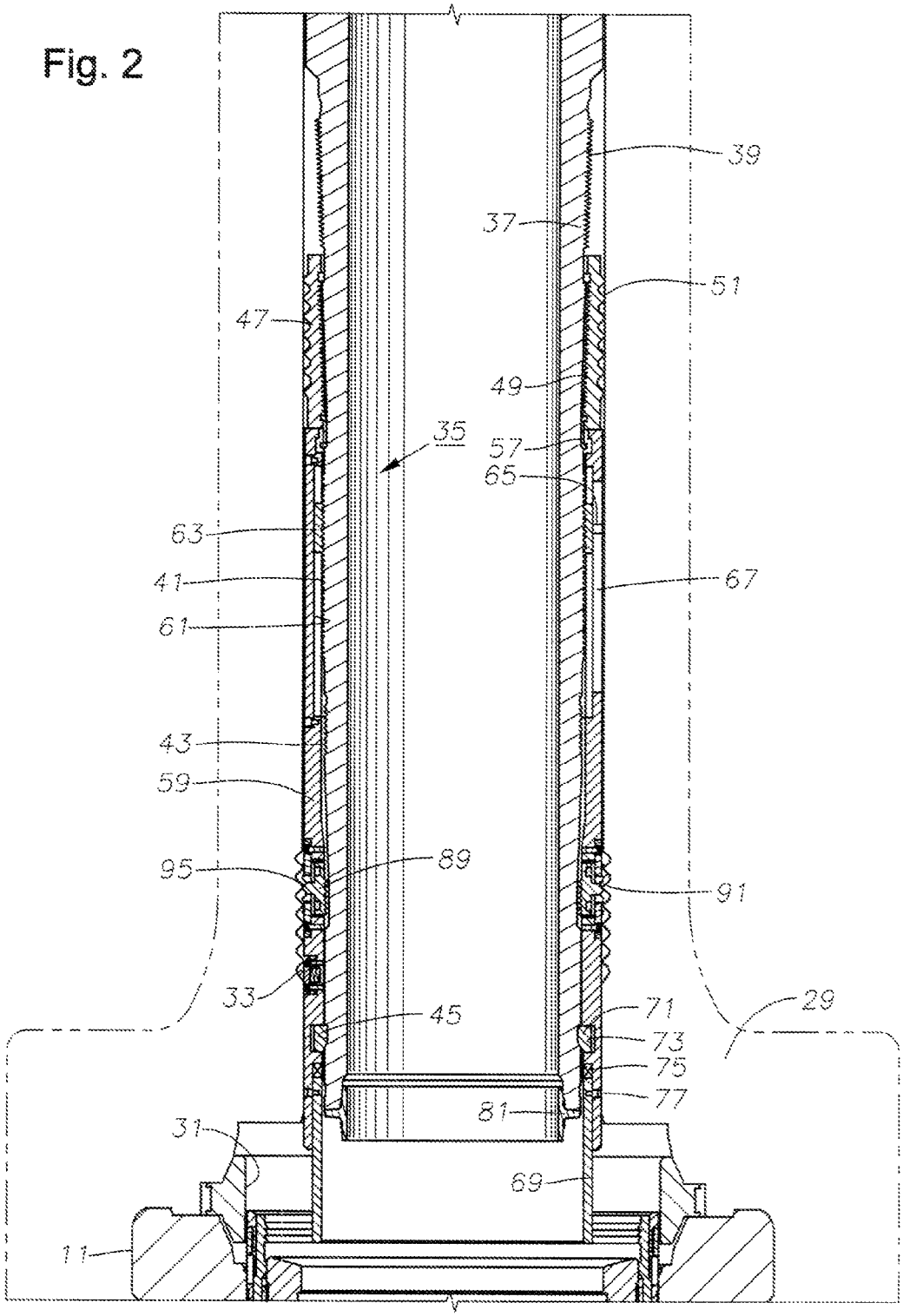
FIG. 2 is a sectional view of the tieback connector of FIG. 1, shown being lowered into a subsea wellhead housing.

Sleeve 59 is mounted to mandrel 37 so that mandrel 37 can move from the upper running in position shown in FIG. 2 to the lower landed position shown in FIG. 1. In this embodiment an internal annular recess 61 accommodates a carrier ring 63 between the annular recess 61 and the exterior of mandrel 37. Carrier ring 63 has internal threads that engage the intermediate external threads 41 on mandrel 37. Carrier 63 has a plurality of pins 65 (only one shown) on its outer diameter. Each pin 65 engages an axially extending slot 67 formed in the wall of sleeve 59. Pins 65 and slots 67 prevent carrier ring 63 from rotating relative to sleeve 59. Elongated slots 67 allow carrier ring 63 to move upward and downward relative to sleeve 59 in unison with mandrel 37. Intermediate threads 41 allow mandrel 37 to rotate relative to sleeve 59. A shoulder at the lower end of each slot 67 prevents sleeve 59 from being accidentally detached from mandrel 37 while being run in.

Figure 7:
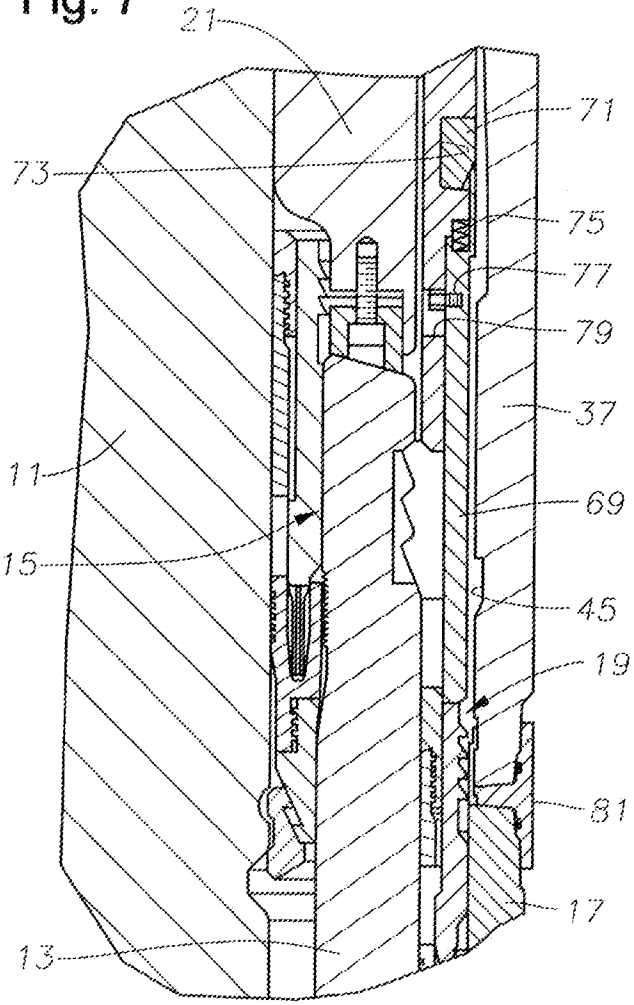
FIG. 7 is an enlarged view of a portion of the tieback connector of FIG. 1, illustrating the actuator sleeve landed on a casing hanger in the wellhead housing.

Referring still to FIG. 1, an actuator 69 is carried on the lower end of sleeve 59. Actuator 69 comprises a sleeve mounted to sleeve 59 below a split ring 71 that is located within an internal groove 73 in sleeve 59. Initially, split ring 71 will be in partial engagement with mandrel external groove 45 and internal groove 73, as shown in FIG. 2. Referring to FIG. 7, actuator 69 is urged downwardly relative to sleeve 59 by springs 75. A retainer screw 77 secures actuator 69 to sleeve 59, but allows some axial movement of actuator 69 relative to sleeve 59 because it is positioned in an axially elongated slot 79. Actuator 69 lands on structure within subsea wellhead housing assembly, and in this example, it lands on a portion of the packoff 19 between casing hangers 13 and 17. When landing, an upper end of actuator 69 cams split ring 71 outward to a fully recessed position within sleeve groove 73. Split ring 71 disengages from mandrel groove 45, allowing mandrel 37 to then move downward relative to sleeve 59.

Referring again to FIG. 1, a seal 81 is carried on the lower end of mandrel 37. Preferably seal 81 is a metal-to-metal seal that seals between mandrel 37 and the inner diameter of an upper end of casing hanger 17.

Figure 5:
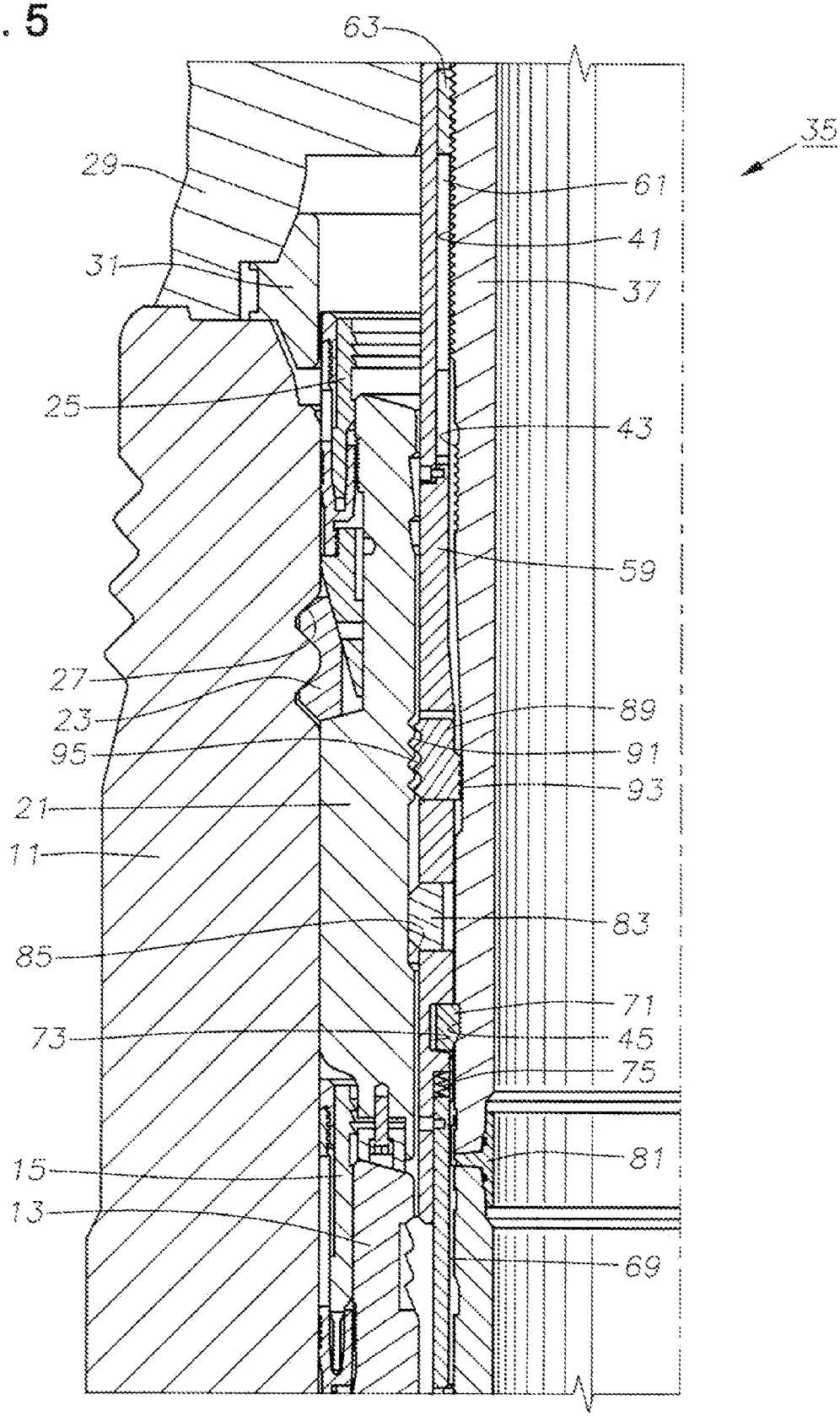
FIG. 5 is an enlarged sectional view of a portion of the tieback connector, illustrating locking dogs for locking the tieback connector to the subsea wellhead housing assembly, and shown prior to engaging the internal profile.
Figure 6:
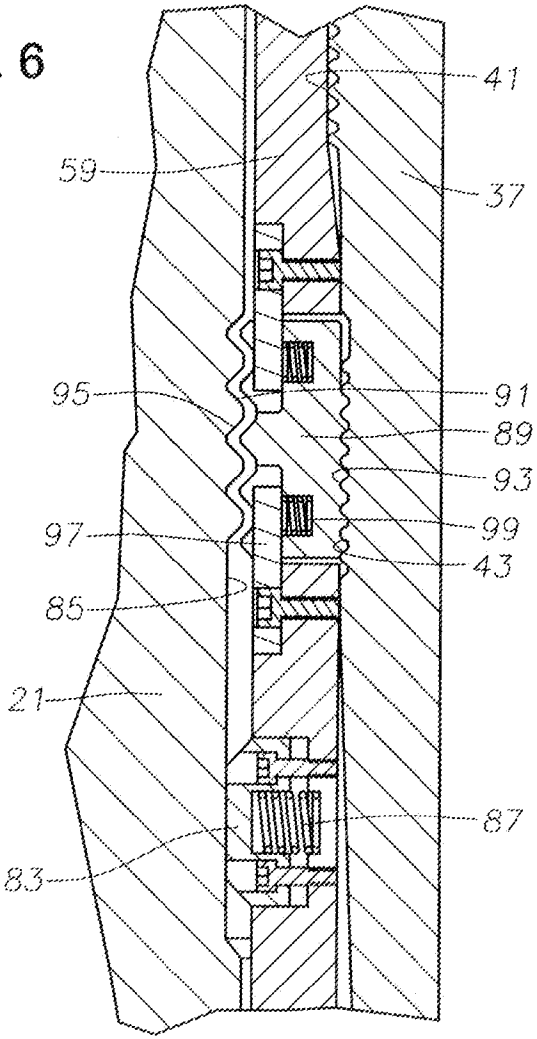
FIG. 6 is a further enlarged view of the tieback connector, illustrating the locking dogs of FIG. 5 in an engaged position with the internal profile.
Figure 8:
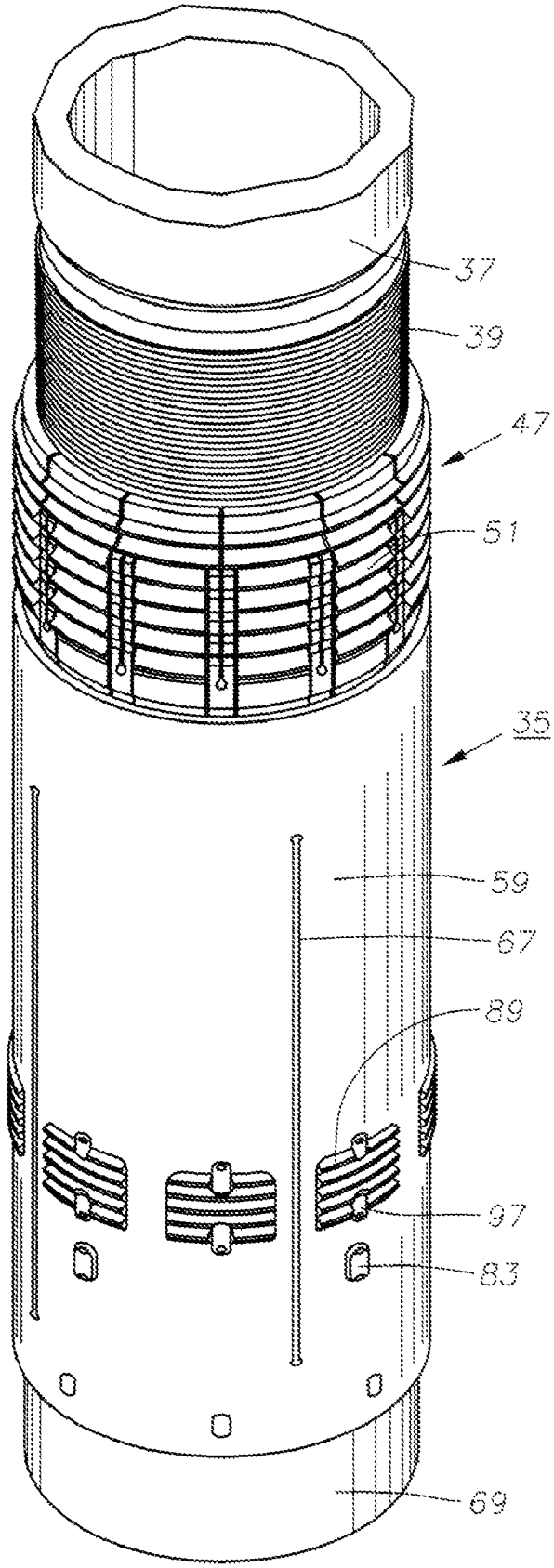
FIG. 8 is a perspective view of the exterior of the tieback connector of FIG. 1.

A plurality of anti-rotation keys 83 will snap into engagement with a mating slot 85 formed in lockdown member 21 in this example. As shown in FIGS. 5, 6 and 8, keys 83 are spaced circumferentially around and extend through openings within sleeve 59. As shown in FIG. 6, each key 83 preferably is biased outward by a coil spring 87. Keys 83 are able to fully retract so that they are flush with within the exterior surface of sleeve 59.

In this embodiment, in addition to locking inner tieback connector 35 to riser 29 with load ring 47, it is also locked to an internal component of subsea wellhead housing 11. In this example, inner tieback connector 35 has a locking member comprising a plurality of dogs 89 spaced around the circumference of sleeve 59. Referring to FIGS. 5 and 6, each dog 89 is located within a window in sleeve 59. Each dog 89 has an external lockdown member profile 95 that partially engages an annular internal profile 91 in lockdown member 21 when fully installed. That is, the dog profiles 95 are aligned with lockdown profile 91, but a slight clearance exists between the teeth of profiles 95 and profile 91. The loose fit while in the fully installed position allows some upward movement of dogs 93 relative to profile 91.

Figure 10:
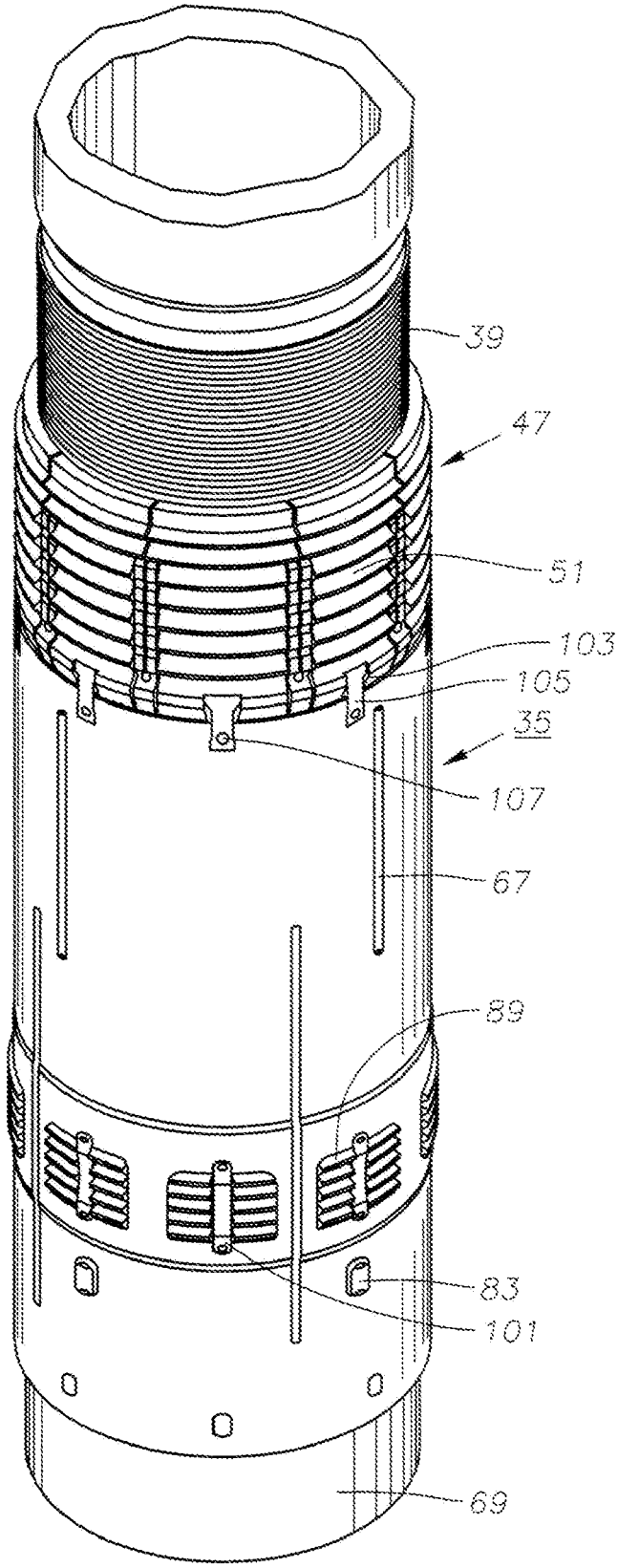
FIG. 10 is a perspective view of an alternate embodiment of the inner tieback connector of FIG. 1.

Also, each dog 89 may have a segment of a thread or groove 93 on its interior surface. Threads 93 are located on an inner surface of each dog 89 and will mate with lower external threads or grooves 43 on mandrel 37. Threads 93 will loosely engage threads 43 and ratchet when mandrel 37 is moving downward relative to dogs 89. Dogs 89 are preferably retained within the windows of sleeve 59 by upper and lower tabs 97 (FIG. 8) or by the arrangement discussed below in connection with the embodiment of FIG. 10. In this embodiment, a coil spring 99 biases each dog 89 inward to a position where its external profile 95 is flush or recessed from the exterior surface of sleeve 59. In the arrangement of FIG. 10, leaf springs are employed.

In operation, inner tieback connector 35 will be assembled as illustrated in FIG. 2 and secured to a string of inner tieback conduit. Mandrel 37 will be in the upper position relative to load ring 47 and sleeve 59. Lower threads 43 will be located above dogs 89. Carrier ring 63 will be in an upper position within recess 61. Split ring 71 will be in engagement with grooves 73 and 45, which holds mandrel 37 in the upper position relative to sleeve 59. Actuator 69 will be extending below seal 81.

Figure 3:
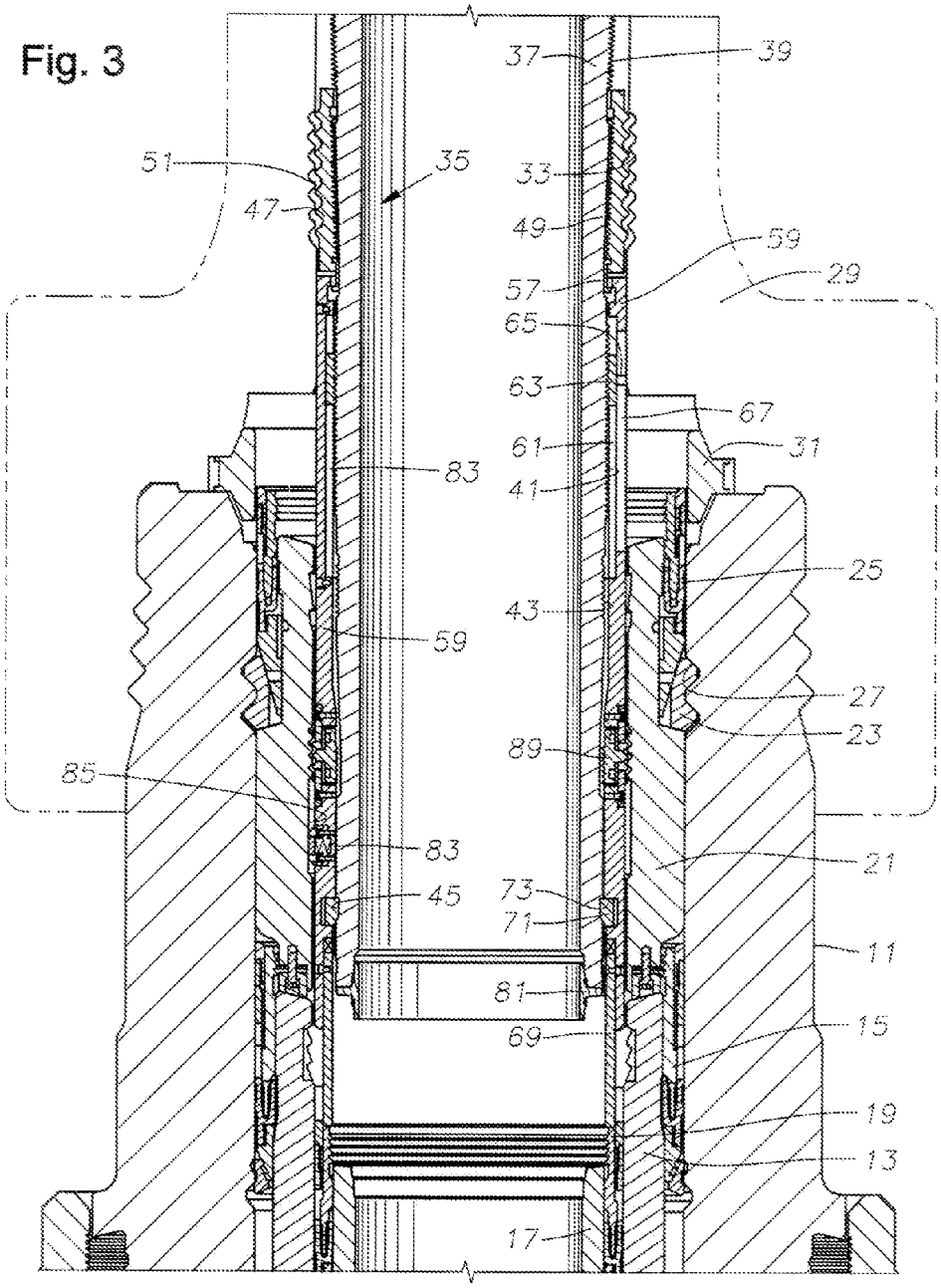
FIG. 3 is a sectional view of the tieback connector of FIG. 1, shown at a lower position in the wellhead housing.

FIGS. 3 and 7 show actuator 69 landing on packoff 19. Actuator 69 pushes split ring 71 outward, freeing split ring 71 from groove 45 and allowing mandrel 37 to move downward. Sleeve 59 does not move downward because it is supported by actuator 69 on packoff 19. Load ring 47 will be aligned with riser internal profile 33, but not yet in engagement. Dogs 89 will be aligned with internal profile 91 in lockdown member 21, but not yet in engagement.

Figure 4:
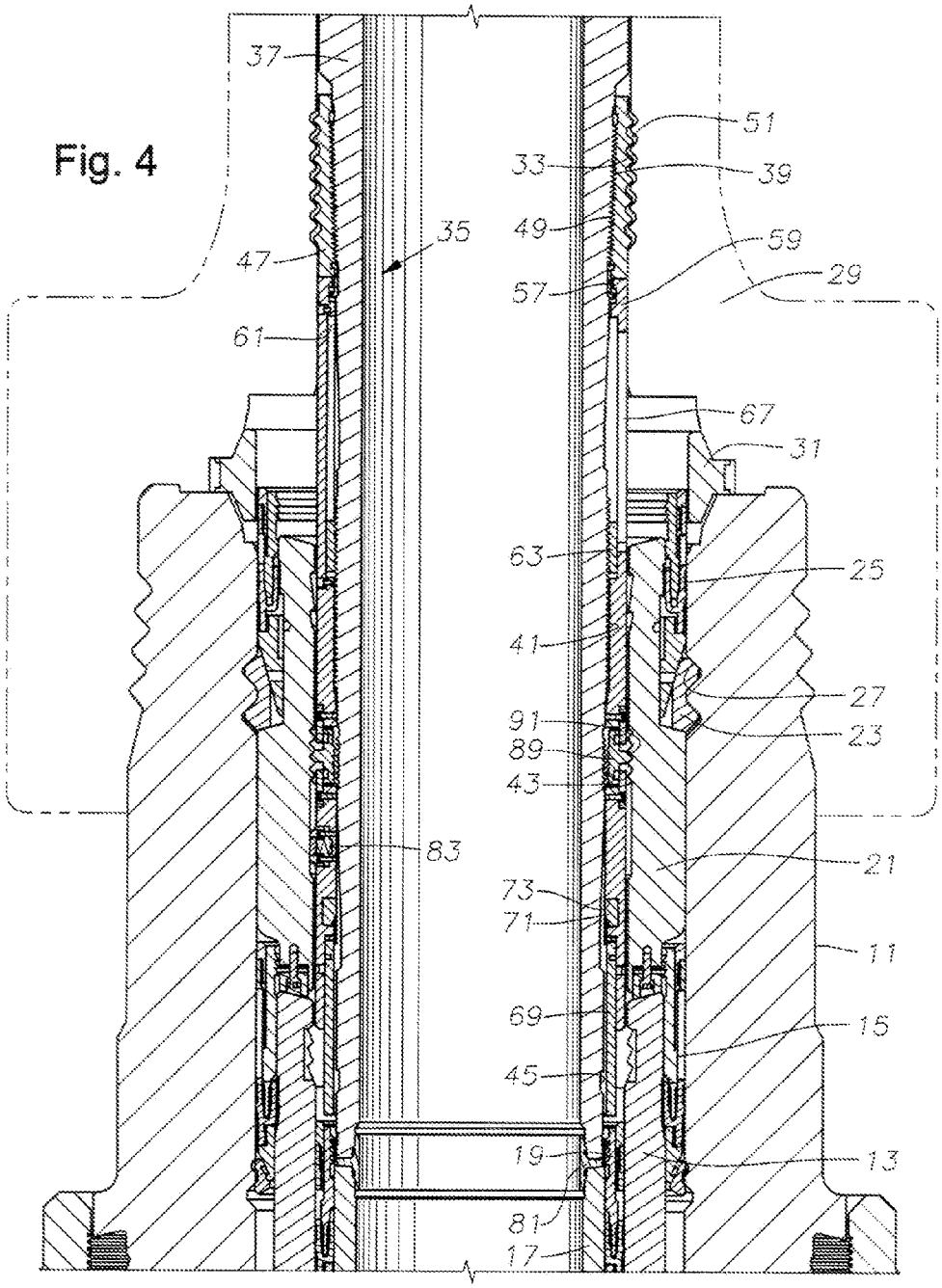
FIG. 4 is a sectional view of the tieback connector of FIG. 1, shown landed in the wellhead housing but prior to rotating the mandrel.

Referring to FIG. 4, when the downward movement of mandrel 37 occurs, upper tapered threads 39 on mandrel 37 will ratchet downward on load ring internal threads 49, causing load ring 47 to radially expand and partially enter riser internal profile 33. The downward movement of mandrel 37 also causes dogs 89 to radially expand as they are cammed outward by cam surface below lower external threads 43. Profiles 95 on dogs 89 will partially enter lockdown member internal profile 91. Seal 81 will move downward near the upper end of casing hanger 17, but will not yet be in sealing engagement with casing hanger 17.

The operator then rotates the inner tieback conduit, which causes mandrel 37 to rotate. Sleeve 59 may initially rotate a short increment, but its anti-rotation keys 83 will soon spring into slots 85, preventing further rotation of sleeve 59, dogs 89, and load ring 47. The rotation of mandrel 37 causes relative axial movement between mandrel 37 and load ring 47. Load ring 47 moves upward, and mandrel 37 downward into tight, preloaded engagement with riser profile 33. Threads 93 of dogs 89 engage lower threads 43 on mandrel 37 but will not make-up tightly. The remaining downward movement of mandrel 37 that occurs while it is rotating causes seal 81 to come into full sealing engagement with casing hanger 17. Afterward, the operator would run tubing, complete the well and install a surface production tree at the platform.

The completed assembly thus locks internal connector 35 both to the stress joint of riser 29 as well as to an internal component of the assembly of subsea wellhead housing 11. If riser 29 were inadvertently disconnected from wellhead housing 11, connector 35 would still remain attached to its connection with lockdown member 21 after a small amount of travel of riser 29. This connection is through the engagement of dogs 89 with profile 91 and the threaded engagement of mandrel threads 43 and dog threads 93. If mandrel 37 and sleeve 59 both began to move upward, profiles 95 of dogs 89 would come into full load bearing contact with lockdown member profile 91, preventing further upward movement. The tight make-up of load ring 47 is not hampered by the loose engagement of dogs 89 with lockdown member profile 91.

In the first method of operation, referring to FIG. 7, after actuator 69 lands on packoff 19, applying sufficient downward weight cams split ring 71 out of engagement with groove 45 and causes mandrel 37 to drop downward from the position of FIG. 3 to the position of FIG. 4. Referring to FIGS. 3 and 4, rather than applying additional weight, the operator may rotate the inner tieback conduit while in the upper position of FIG. 3. This rotation causes mandrel 37 to rotate relative to load ring 47. Mandrel threads 39 engage load ring threads 49, causing mandrel 37 to move downward to the position in FIG. 4. The tool can thus be operated in two different modes.

The embodiment of FIG. 10 shows two changes from the first embodiment. In the first embodiment coil springs 99 (FIG. 6) urge dogs 89 inward and tabs 97 (FIG. 8) retain each dogs 89 within one of the windows in sleeve 59. In the embodiment of FIG. 10, a leaf spring 101 extends across each window in contact with the outer side of each dog 89. Leaf springs 101 replace coil springs 99 (FIG. 6) and tabs 97.

The second feature that differs is to replace clamp 57 (FIG. 1), which retains load ring 47 with sleeve 59. Instead, a plurality of dovetail slots 103 are formed in the lower edge of load ring 47'. A plurality of links 105 are connected between slots 103 and sleeve 59. Each link 105 has an upper end or head that fits within one of the dovetail slots 103. A threaded bolt or fastener 107 secures the lower end of each link 105 to the outer surface of sleeve 59.

While the invention has been shown in only two of its forms, it should be apparent to those skilled in the art that it is not so limited but susceptible to various changes without departing from the scope of the invention. For example, in some cases the locking dogs could be eliminated, with the sole connection being to the external riser. Alternately, the locking dog arrangement could be employed with other tubular members wherein another outer tubular member would take the place of lockdown member 21 and another inner tubular member would take the place of mandrel 37. Also, if an external riser is not employed, the load ring could be positioned lower and engage structure within the subsea wellhead housing.

The invention claimed is:

1. A method for securing a conduit to a subsea well assembly, comprising:

(a) providing the subsea well assembly with first and second internal profiles axially spaced apart from each other relative to an axis of the subsea well assembly;

(b) providing a connector having first and second locking members axially spaced apart from each other;

(c) securing the connector to a conduit string, and lowering the connector into the subsea well assembly; then (d) rigidly securing the first locking member to the first internal profile;

(e) partially securing the second locking member to the second internal profile, such that the second locking member is axially movable a limit amount relative to the second internal profile; then (f) in the event the connector along with the first and second locking members begin to move upward relative to the second internal profile, causing the second locking member to move from partial into full engagement with the second internal profile, limiting the upward movement of the connector.

2. The method according to claim 1, wherein step (a) comprises placing the first internal profile above the second internal profile.

3. The method according to claim 1, further comprising:

extending a riser from a surface vessel and connecting a lower end portion of the riser to a subsea wellhead, the lower end portion of the riser and the subsea wellhead defining the subsea well assembly;

wherein step (a) comprises forming the first internal profile in the lower end portion of the riser and the second internal profile in the subsea wellhead.

4. The method according to claim 1, wherein step (d) comprises rotating the connector and the first locking member relative to the subsea well assembly.

5. The method according to claim 1, wherein step (e) comprises rotating the connector relative to the second locking member and the subsea well assembly, which forces the second locking member radially outward into partial engagement with the second internal profile.

6. The method according to claim 1 wherein rotating the conduit string simultaneously causes steps (d) and (e) to occur.

7. The method according to claim 1, further comprising energizing a seal of the connector against a component of the subsea well assembly.

8. A method for tying back a subsea well assembly to a surface platform comprising:

(a) providing the subsea well assembly with an upper internal profile and a lower internal profile;

(b) providing a tieback connector with a load ring and a locking member located below the load ring;

(d) connecting the tieback connector to a string of tieback conduit, and lowering the tieback connector into the subsea well assembly;

(d) rigidly securing the load ring to the upper internal profile;

(e) partially securing the locking member to the lower internal profile; then (f) in the event the tieback connector along with the load ring and the locking member begin to move upward relative to the lower internal profile, the upward movement causes the locking member to move from partial into full engagement with the lower internal profile, limiting the upward movement of the tieback connector.

9. The method according to claim 8, further comprising:

extending a riser from a surface vessel and connecting a lower end portion of the riser to a subsea wellhead, the lower end portion of the riser and the subsea wellhead defining the subsea well assembly;

wherein step (a) comprises forming the upper internal profile in the lower end portion of the riser and the lower internal profile in the subsea wellhead.

10. The method according to claim 8, wherein step (d) comprises rotating the tieback conduit and the load ring relative to the upper internal profile.

11. The method according to claim 8, wherein step (e) comprises rotating the tieback conduit and at least part of the tieback connector relative to the subsea well assembly, which forces the locking member radially outward relative to an axis of the tieback connector.

12. The method according to claim 8 wherein rotating the tieback conduit simultaneously causes steps (d) and (e) to occur.

13. The method according to claim 8, further comprising energizing a seal of the tieback connector against a component of the subsea well assembly.

14. The method according to claim 8, further comprising:

extending a riser from a surface vessel and connecting a lower end portion of the riser to a subsea wellhead that supports a casing hanger, the lower end portion of the riser and the subsea wellhead defining the subsea well assembly;

wherein step (b) further comprises mounting a seal to the tieback connector; and the method further comprises energizing the seal against the casing hanger.

15. The method according to claim 8, wherein energizing the seal with the casing hanger occurs simultaneously with step (d).

16. A subsea well apparatus, comprising:

a subsea well assembly having first and second internal profiles axially spaced apart from each other relative to an axis of the subsea well assembly;

a connector having first and second locking members axially spaced apart from each other, the connector adapted to be secured to a conduit string deployed from a surface vessel;

the first locking member having a run-in position and an engaged position rigidly secured to the first internal profile;

the second locking member having a run-in position and an engaged position partially secured to the second internal profile, such that the second locking member is axially movable a limit amount relative to the second internal profile; and in the event the connector along with the first and second locking members begin to move upward relative to the second internal profile, the upward movement causing the second locking member to move from partial engagement into full engagement with the second internal profile, limiting the upward movement of the connector.

17. The apparatus according to claim 16, wherein the first internal profile is located above the second internal profile.

18. The apparatus according to claim 16, wherein:

the subsea well assembly comprises a lower portion of a riser connected to a subsea wellhead housing;

the first internal profile is within the lower portion of the riser; and the second internal profile is within the wellhead housing.

19. The apparatus according to claim 16, further comprising:

a seal on a lower portion of the connector for sealingly engaging a component within the subsea well assembly.

20. The apparatus according to claim 16, wherein the first and second locking members expand radially outward when moving from the run-in to the engaged positions.

* * * * *